US006205829B1

(12) United States Patent
Schwedt

(10) Patent No.: US 6,205,829 B1
(45) Date of Patent: Mar. 27, 2001

(54) METHOD OF REGULATING TENSION/ COMPRESSION IN A MULTI-FRAME HOT ROLLING MILL, AND A CORRESPONDING CONTROL SYSTEM

(75) Inventor: Joseph Schwedt, Belfort (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/479,904

(22) Filed: Jan. 10, 2000

(30) Foreign Application Priority Data

Jan. 11, 1999 (FR) ..... 99 00181

(51) Int. Cl.[7] ..... B21B 37/58
(52) U.S. Cl. ..... 72/10.2
(58) Field of Search ..... 72/10.2, 10.3, 72/10.7, 12.1, 13.1, 13.2, 13.4, 13.5, 13.6

(56) References Cited

U.S. PATENT DOCUMENTS 3,457,747 * 7/1969 Yeomans ..... 72/10.2
4,408,470 * 10/1983 Fromont et al. ..... 72/10.2

FOREIGN PATENT DOCUMENTS 32 05 589 A1 8/1982 (DE) .
43 25 074 A1 5/1994 (DE) .
2 354 154 1/1978 (FR) .
57-100812 * 6/1982 (JP) ..... 72/10.2
60-166112 * 8/1985 (JP) ..... 72/10.3
1-62205 * 3/1989 (JP) ..... 72/10.2

OTHER PUBLICATIONS

Baur, K.: "Einsatz von Rechnern in Draht–Und Feinstahlstrassen" Stahl Und Eisen, vol. 102, No. 18, Sep. 6, 1982, pp. 861–866, XP002099791 ISSN: 0340–4803.

* cited by examiner

*Primary Examiner*—Ed Tolan
(74) *Attorney, Agent, or Firm*—Sughrue, Mion, Zinn, Macpeak & Seas, PLLC

(57) ABSTRACT

The value of the rolling torque is measured at each frame through which a metal product passes, and the measurement is performed at the moment when said product reaches the following frame, at which point the frame at which the measurement is performed is switched over to torque regulation. The last frame reached by the product remains in speed regulation and it acts as a controlling frame for all other frames situated upstream therefrom so as to enable them to conserve torque equal to their respective reference torques by adapting their speeds. Once the reference torque measurements have been stored in the control system, regulation is obtained by making use of a distribution key for the stresses between the frames.

4 Claims, 1 Drawing Sheet

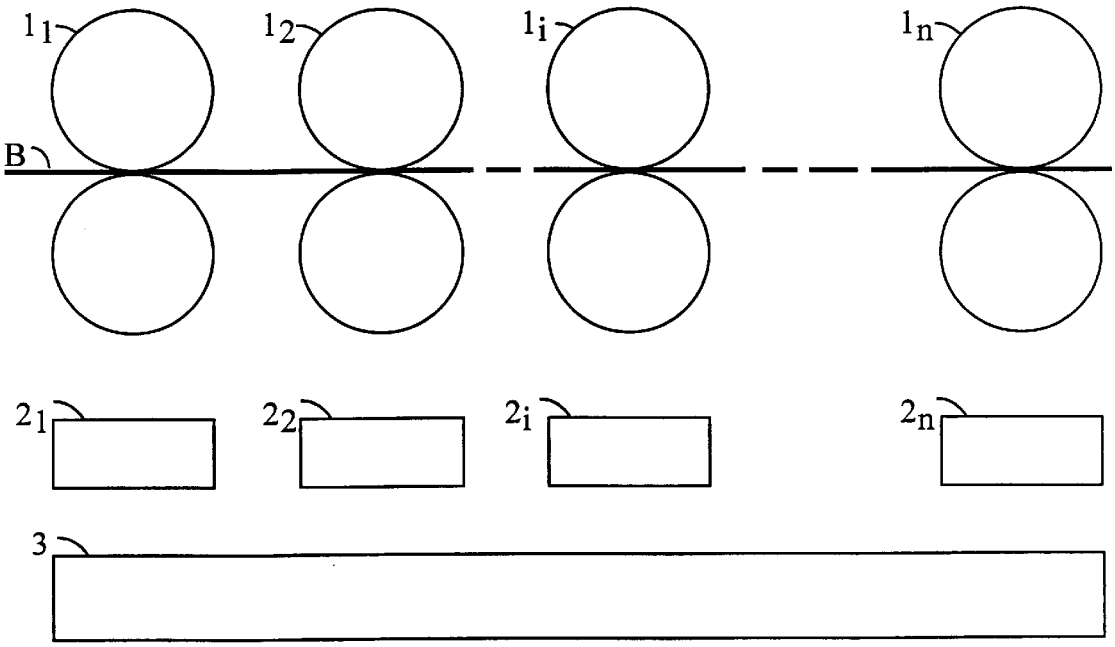
$1_1$
$1_2$
$1_i$
$1_n$
B
$2_1$
$2_2$
$2_i$
$2_n$
3

METHOD OF REGULATING TENSION/ COMPRESSION IN A MULTI-FRAME HOT ROLLING MILL, AND A CORRESPONDING CONTROL SYSTEM

The invention relates essentially to a method of regulating a multi-frame hot rolling mill, and in particular a multi-frame mill that does not have force sensors. The method is intended more particularly to eliminate interfering tension/compression stresses to which a product is subjected while being rolled, which product may be of the bar, sheet, or metal section member type.

BACKGROUND OF THE INVENTION

As is known, rolling operations lead inevitably to variations appearing to some extent in the magnitudes that are associated with deformation of the metal being rolled. This is a consequence in particular of the fact that the rolling forces and torques, the temperature of the rolled product, and the coefficients of friction do not remain accurately constant during rolling. Inaccuracies due to the way the rolling process is controlled cannot be eliminated completely, and for example there are small variations in instantaneous speeds. There are also disturbances which are due to oscillations caused by imperfections in the drive system of the mill or indeed to wear of the tools used. Variations in the rolling magnitudes and dimensional variations of the product as fed to the mill also contribute to degrading the dimensional attributes of the finished product. As a consequence of all these disturbances, the reference tensions specified by a rolling plan for the various frames of a mill are not complied with. This gives rise to tension or compression stresses being present in those portions of the product that are situated in the intervals between frames.

Tension or compression appear in a product that is engaged in a plurality of successive frames in a continuous run particularly when the product is being inserted into the frames and when the preadjusted speed of each frame is not perfect. If the downstream frame is tending to pull the upstream frame then the product present between the frames will be working in traction; if the upstream frame is tending to push the downstream frame by means of the product, then it is subjected to compression. The difference between the speed $Vs_{n-1}$ of a product leaving an upstream frame and its speed $Ve_n$ entering the following frame downstream gives rise to stress $\Delta\tau$ which is expressed by Hooke's law, and is as defined below:

$$\Delta\tau = \frac{E\int(Ve_n - Vs_{n-1})dt}{L}$$

where $\Delta\tau$ is the variation in tensile or compressive stress to which the metal is subjected between the two frames, where L is the distance between the frames, and where E is Young's modulus.

When the outlet speed $Vs_{n-1}$ of the upstream frame referenced n−1 is not in balance with the inlet speed $Ve_n$ of the following frame referenced n, then the stress in the metal in the interval between the frames modifies and the operating point of each of the two frames shifts towards an equilibrium point where the outlet speed from the upstream frame is equal to the inlet speed of the following frame. As is known, this modification gives rise to modifications in the thickness of the rolled metal and to variations in the slip in the two frames concerned. A phenomenon arises whereby the rolling process is self-stabilizing, but this phenomenon is to the detriment of dimensional tolerances for the product and for the desired profile.

Tensile and compressive forces also appear in a product engaged in a plurality of successive frames during rolling whenever the product is not totally uniform over its entire length and presents variations in section and/or hardness that are associated, for example, with variations in temperature. Thus, variation in the hardness of a product entering a frame n−1 gives rise to variation in its section on leaving said frame and to variation in downstream slip, thus leading to a modification in the rate at which metal is output from the frame.

To remedy those drawbacks, there exist control systems applied to multi-frame mills that include means for monitoring traction in the various intervals between frames by individually regulating the ratio of rolling torque over rolling force on a frame-by-frame basis. Such regulation requires sensors to be present, and in particular rolling force sensors which are expensive, difficult to install and maintain, and which constitute a potential source of breakdowns. In addition, that solution which requires the presence of sensors is not always applicable, particularly in rolling mills for producing bars or girders in which such sensors are rarely installed.

OBJECTS AND SUMMARY OF THE INVENTION

The invention thus provides a method of estimating and regulating tension and compression in a multi-frame rolling mill working on hot metal products.

According to a characteristic of the invention, starting from an initial situation while a product is being passed into the various frames of the run, torque is measured at each frame through which the product passes at the moment when said product reaches the following frame downstream therefrom, the measured value is stored as a reference value, and the frame for which the measurement is made is switched from speed regulation to torque regulation. The last frame into which the product enters acts as a speed controlling frame for all other frames situated upstream therefrom, thereby enabling it to retain torque equal to its reference torque by varying its speed.

Continuous updating of the estimated traction torque and of the rolling torque for zero traction is performed at each frame, and the estimated inter-frame traction values make it possible to regulate these values to levels which are predefined in the rolling plan. This makes it possible to set out to perform rolling with minimal inter-frame traction levels, as recommended by numerous mill operators.

According to a characteristic of the invention, from the moment when reference torque measurements have been stored as rolling reference values, a distribution key for traction stresses between frames of the run is used such that:

$$\Delta C_{T,i} = \Delta C_i - \frac{\lambda_i}{\sum\lambda_i} S_o \frac{R_i}{r_i}$$

where:

- $\Delta C_{T,i}$ corresponds, depending on its sign, to the variation in the traction or compression stress for the frame of rank i amongst the n frames of the run;
- $R_i$ and $r_i$ are the working radius and the reduction ratio for the frame of rank i;
- $S_0$ corresponds to the sum of the measured resistive torque variations ($\Delta C_i$) as seen by the mechanism ($\Delta C_i.r_i$) and divided by the lever arm ($\Delta C_i.r_i/R_i$), where $\Delta C_i$ is the variation in the resistive torque $C_i$ relative to the reference torque stored for the frame of rank i;

with $\lambda_i$ equal to zero, either if the product $S_0.\Delta C_i$ is negative, or if the product $S_0.\Delta C_i$ is positive when dealing with the first frame and the measured variation of resistive torque $\Delta C_i$ offset as a function of speed through the second frame exceeds a parameterizable threshold, or else if the product $S_0.\Delta C_i$ is positive while the measured variation of resistive torque $\Delta C_{i-1}$ is greater than a second parameterizable threshold and said measured variation of resistive torque $\Delta C_{i-1}$ offset as a function of the speed through the frame i, where i>1, is less than a third parameterizable threshold; or $\lambda_i$ is equal to $\Delta C_i$ if the product $S_0.\Delta C_i$ is positive when dealing with the first frame and the measured variation of resistive torque $\Delta C_i$ offset as a function of speed through the second frame is less than a fourth parameterizable threshold, or indeed when dealing with some other frame and the measured variation of resistive torque $\Delta C_{i-1}$ is less than a fifth parameterizable threshold, or said torque variation $\Delta C_{i-1}$ offset as a function of the speed through frame i, where i>1, is greater than a sixth parameterizable threshold.

The invention also provides a system for controlling a multi-frame rolling mill that operates on hot metal products, in which the frames are controlled by programmed logic control units placed under the control of at least one common supervisor unit, the system including hardware and software means enabling it to implement the method as defined above.

BRIEF DESCRIPTION OF THE DRAWING

The invention, its characteristics, and its advantages are described in greater detail in the following description given with reference to the FIGURE mentioned below.

The sole FIGURE is a block diagram of a multi-frame rolling mill.

MORE DETAILED DESCRIPTION

The rolling mill shown in the sole figure is assumed to be a hot mill for transforming metal products B. For example, it might be a run for making wire, or section member, or bar, or indeed strip or plate. The run is conventionally made up of a plurality of successive frames 1 represented by a frame $\mathbf{1}_1$ at the entrance to the run, a frame $\mathbf{1}_n$ at the outlet from the run, and intermediate frames, of which only frames $\mathbf{1}_2$ and $\mathbf{1}_i$ are shown, each frame being represented by a respective pair of cylinders.

In conventional manner, the cylinders of the frames are driven by electric motors each under the control of a corresponding control unit 2, e.g. a unit $\mathbf{2}_1$, $\mathbf{2}_2$, $\mathbf{2}_i$, or $\mathbf{2}_2$. These units are themselves parts of a control system in which they are under the control of at least one supervisor unit 3. The control and supervisor units are assumed to be of the programmed logic type and they are implemented around processors with which various memories and specialized interfaces are associated, in particular for controlling the frames and for enabling the mill to be operated by the operating personnel. The respective structures and functions of these component elements combining hardware means with software means are well known to the person skilled in the art and are described in detail herein only for those portions that relate directly to the subject matter of the invention.

As mentioned above, the method of the invention seeks to eliminate interfering tension/compression stresses in coordinated manner by taking action on the motors of the mill frames while using as references the torques developed by the various frames so as to obtain a "minimum traction" state in the rolled product as said product passes through each of the frames.

There are two advantageous in controlling such a continuous run for minimum traction: firstly it enables a constant minimum stress to be maintained in the product, thereby improving quality; and secondly it enables the stages during which the frames are adjusted to be reduced, thereby avoiding wastage due to initial product not being to specification. Control should be applied both when the product is being inserted into a frame and over the entire length of the product.

In the present case, minimum traction control on insertion is based on using a torque memory device which assumes that the value $C_L$ for the rolling torque is known.

In conventional manner, this value can be determined from the following relationship:

$$J\frac{d\omega}{dt} = K\cdot\Phi\cdot I - C_L - C_P$$

where I is the induced current in the motor of the frame, $\Phi$ is the induction field in the motor, $\omega$ is the angular speed of rotation, J is inertia as seen on the motor shaft, K is the torque coefficient, and $C_p$ is the mechanical loss torque.

The induction in the motor is reconstituted on the basis of measuring the speed of rotation $\omega$ of the motor. The rolling torque is written:

$$CL = \frac{\omega_{base}}{\mathrm{Max}(\omega,\ \omega_{base})}\frac{C_N}{I_N}I - J\frac{d\omega}{dt} - C_P$$

where $C_N$ and $I_N$ represent respectively the nominal torque and the nominal current of the motor.

The rolling torque of a frame can be calculated in real time in the speed-varying unit that is assumed to be included in the control unit of the frame. It is then obtained from the torque reference $C_m$ obtained at the outlet of the speed stage, and from the measured speed.

The rolling torque $C_L$ is then calculated as follows:

$$C_L = C_M - J\cdot\frac{d\omega}{dt} - C_P$$

Filtering performed on the reference torque serves to put the torque and speed signals into phase so as to improve the accuracy with which the rolling torque is determined.

An example of the torque memory device is described herein with reference to the first two frames of the run shown diametrically in the single FIGURE. This device acts on the basis of an initial situation in which the motors of the two frames are regulated in terms of speed, said regulation being implemented in conventional manner, e.g. by means of a speed-varying unit of the Applicants' SYCONUM type.

The rolling torque of the frame $\mathbf{1}_1$ is measured immediately before a product that is being rolled by the frame $\mathbf{1}_1$ enters the frame $\mathbf{1}_2$. At that moment there is no traction or compression upstream or downstream of the frame $\mathbf{1}_1$. The torque value as determined in this way is then stored as an initial reference value for the subsequent rolling period.

Following this measurement and corresponding storage thereof, the motor of the frame $\mathbf{1}_1$ is switched over from speed regulation to torque regulation. As soon as the product penetrates into frame $\mathbf{1}_2$, it is the frame $\mathbf{1}_2$ which is being regulated in terms of speed that acts as the pilot frame for the frame $_1$, while the frame $\mathbf{1}_1$ then adapts its own speed in such a manner as to maintain its torque equal to its reference torque.

The presence of product in a frame is indicated by the presence of a "product in frame" signal. This signal is generated by the speed-varying unit of a frame in the absence of a speed transient whenever the instantaneous rolling torque is greater than a threshold value that is fixed or that is possibly determined as a function of the product to be rolled, and secondly when the instantaneous rolling torque is greater than a threshold for some determined length of time, if a speed transient is taking place.

The synchronization achieved in this way between the two frames serves to ensure that there is no stress in the interval between the frames, after the end of a transient phenomenon due to mechanical inertias. Synchronization is obtained by taking account of electrical parameters that are measured in conventional manner at the power supplies to the frame motors. This therefore avoids problems of implementation and of stability of the kind conventionally associated with sensors, when sensors are present.

The device is very sensitive insofar as variations in traction that take place downstream from a frame give rise to large variations of rolling torque in the frame.

Once no traction is achieved in the interval between the first two frames, it is possible to repeat the operation for the third frame and so on for all of the following frames of the mill. Each frame by turn should control the frames situated upstream therefrom until control is taken over by the next frame.

It is also possible to envisage using such a torque memory device, when it is desired that a product should be subjected to a determined amount of traction or compression in the interval between frames; in which case the torque value $C_{0,i}$ stored for a frame $\mathbf{1}_i$ immediately before the product reaches the frame $\mathbf{1}_{i+1}$ is modified by adding thereto the amount of traction or compression torque that is desired, such that $C_{0,i}$ becomes:

$$C_{0,i} - T_{i,i+1} \cdot \frac{R_i}{r_i}$$

where $T_{i,i+1}$ is the value for the inter-frame traction or compression depending on whether it is positive or negative, and where $R_i$ and $r_i$ are the working radius and the reduction ratio of the frame $\mathbf{1}_i$.

Provision is also made to store the speed correction to which the torque memory device gives rise for any given frame while rolling a product, relative to the nominal initial reference value fixed by the operator or specified in the rolling plan, so as to correct said reference value for the following product to be rolled, if the products are uniform from one to another. This makes it possible for the various frames of the run to train themselves on the basis of the corrections performed at the beginning of rolling.

Nevertheless, the use of the torque memory device during the insertion stage is preferably not conserved in this form during the remainder of the rolling operation so as to ensure that not all torque variation is considered as being a variation of inter-frame traction.

Thus, all of the frames involved are torque regulated, other than the last frame which is controlling speed, but it is not resistive torque which is kept constant as during the insertion stage. Only that portion of the torque which corresponds to the traction torque of the frame is regulated. A characteristic of the invention is to provide means for estimating the various levels of traction between frames with good accuracy. The regulated traction level generally corresponds to a level which is close to zero, i.e. no traction, but it could also corresponds to any other desired level.

For any frame i, changeover from the insertion stage to the normal rolling stage occurs as soon as the product enters the frame i+1 and the resistive torque of the stage i+1 becomes stable, because the impact transient has terminated.

It should be observed that the last frame working in the run is used as a frame for controlling the speed of all the other frames situated upstream therefrom in the mill. Any variation in speed that occurs at this last frame must therefore be reflected in cascade on all of the other frames placed upstream therefrom, and this is achieved by a device for regulating speed ratios between frames.

The purpose of this device is to control the throughput of the run at each frame during the stages in which the product is inserted and during acceleration of the run as a whole, and it is designed to ensure that the ratio between the speeds of rotation of two successive stages, such as stages $\mathbf{1}_1$ and $\mathbf{1}_{i+1}$ remains constant by acting on the upstream one of each frame pair.

To this end, the speed ratio regulator device stores, as its reference value, the ratio of the speeds of rotation $(\omega_{i-1}/\omega_i)_0$ for the frames $\mathbf{1}_{i-1}$ and $\mathbf{1}_i$ when the frame $\mathbf{1}_i$ is switched over to torque regulation, immediately before the product that is being rolled reaches the inlet to frame $\mathbf{1}_{i+1}$, so as to have this reference value available later on during rolling.

The speed of frame $\mathbf{1}_i$ adapts automatically on the product being rolled penetrating into the frame $\mathbf{1}_{i+1}$ because of the torque regulation, and it triggers a correction to the speed of the frame $\mathbf{1}_{i-1}$ situated upstream therefrom by a value:

$$\Delta V_{i-1} = \left(\frac{\omega_{i-1}}{\omega_i}\right)_o \cdot \Delta V_i$$

All of the frames of the mill situated upstream therefrom then synchronize in succession under the effect of speed ratio regulation being performed specifically on each drive.

During normal rolling, the principle remains exactly the same. Traction between frames i and i+1 is regulated by acting on the speed of the motor for frame i, and as before, all of the frames of the mill upstream therefrom then synchronize themselves in succession under the effect of the speed ratios being regulated specifically for each of the drives.

The algorithm for estimating all of the traction between frames stems from the following reasoning:

It is assumed initially that there is no tension or compression stress in the product at the input to the input frame $\mathbf{1}_i$ and at the outlet from the outlet frame $\mathbf{1}_n$ of the mill, and it is assumed that the zero-traction rolling torques are constant and that variations in resistive torque at each stage are due only to variations in traction torques between frames. It is then possible to define the following relationships for the various frames of a mill.

$$\begin{cases} \Delta C_1 = -\dfrac{T_1 \cdot R_1}{r_1} \\ \Delta C_2 = -\dfrac{T_2 \cdot R_2}{r_2} + \dfrac{T_1 \cdot R_2}{r_2} \\ \Delta C_i = -\dfrac{T_i \cdot R_i}{r_i} + \dfrac{T_i - 1 \cdot R_i}{r_i} \\ \Delta C_n = +\dfrac{\Delta T_{n-1} \cdot R_n}{r_n} \end{cases}$$

where $\Delta C_i$ is variation in the resistive torque relative to the stored torque for frame $\mathbf{1}_i$, where $T_i$ is the tension or compression between frames, depending on its sign, and where $R_i$ and $r_i$ are the working radius and the reduction ratio for the frame $\mathbf{1}_i$.

These relationships make it possible to establish the following equation:

$$\sum_{i=1}^{n} \frac{\Delta C_i \cdot r_i}{R_i} = (0 - T_1) + (T_1 - T_2) + \ldots + (T_{i-1} - T_i) + \ldots + (\Delta T_{n-2} - \Delta T_{n-1}) + (\Delta T_{n-1} - 0) = 0$$

The rolling torque for a frame, as measured indirectly from the motor torque for said frame, is made up of two components corresponding respectively to the rolling torque at zero traction and to the traction or compression torque. It can be expressed by the equation:

$$C_L = C_{L,0} + (T_{\text{in}} - T_{out})\frac{R}{r}$$

where $C_L$ is the rolling torque as seen by the motor of the frame, where $C_{L,0}$ is the rolling torque at zero traction as seen by the motor, and where $t_{in}$ and $T_{0ut}$ are the traction or compression between frames respectively at the inlet and at the outlet of the frame under consideration.

The first of the two components corresponds to the torque to be delivered by the motor of a frame in the absence of any traction or compression upstream or downstream from the frame. The second of these components has the effect of increasing or decreasing the torque to be delivered by the motor of the frame under consideration, as appropriate.

When variations in tension or compression stresses between frames are associated with variations in the hardness or the temperature of the product being rolled, or indeed with dimensional errors in said product, then the above-defined relationships become:

$$\begin{cases} \Delta C_1 = \Delta C_{L,0,1} - \dfrac{T_1 \cdot R_1}{r_1} \\ \Delta C_2 = \Delta C_{L,0,2} - \dfrac{T_2 \cdot R_2}{r_2} + \dfrac{T_1 \cdot R_2}{r_2} \\ \Delta C_i = \Delta C_{L,0,i} - \dfrac{T_i \cdot R_i}{r_i} + \dfrac{T_i - 1 \cdot R_i}{r_i} \\ \Delta C_n = \Delta C_{L,O,n} + \dfrac{\Delta T_{n-1} \cdot R_n}{r_n} \end{cases}$$

These relationships give rise to the following equation:

$$\sum_{i=1}^{n} \Delta C_i \cdot \frac{r_i}{R_i} = \sum_{i-1}^{n} \Delta C_{L,O,i} \cdot \frac{r_i}{R_i} = S_0$$

where $S_0$ corresponds to the sum of the rolling torque variation ($\Delta C_i$) as seen by the mechanism ($C_i.r_i$) and divided by the lever arm ($\Delta C_i.r_i/R_i$).

This makes it possible in real time to calculate the signal $S_0$ since all of the resistive torques are accessible either directly from torque meters, or else indirectly by determining the motor torques on the basis of electrical measurements which are performed for each motor and which are made available in the control units of the motors.

It is also possible to determine the origin of a variation in resistive torque for a given frame, i.e. a change to the zero traction rolling torque $C_{L,0,i}$ or the appearance of a tension or compression stress at the inlet and/or the outlet of the frame, and also the relative contribution of each of these possible causes on the final variation in the resistive torque.

A key to distribution of contributions in this case can thus be written by means of the following equation:

$$\Delta C_{L,0,i} = \beta \cdot \lambda_i \cdot S_0 \cdot \frac{R_i}{r_i}$$

where $\Delta C_{L,O,i}$ represents variation in the rolling torque at zero traction for frame i and where $\lambda_i$ is given by the following algorithm, in which:

$\lambda_i$ is equal to zero, either if the product $S_0.\Delta C_i$ is negative, or if the product $S_0.\Delta C_i$ is positive for the first frame and the measured variation of resistive torque $\Delta C_i$ offset as a function of speed through the second frame exceeds a parameterizable threshold, or else if the product $S_0.\Delta C_i$ is positive while the measured variation of resistive torque $\Delta C_{i-1}$ is greater than a second parameterizable threshold and said measured variation of resistive torque $\Delta C_{i-1}$ offset as a function of the speed through the frame i, where i>1, is less than a third parameterizable threshold; or $\lambda_i$ is equal to $\Delta C_i$ if the product $S_0.\Delta C_i$ is positive, if the frame is the first frame and the measured variation of resistive torque $\Delta C_i$ offset as a function of the speed through the second frame is less than a fourth parameterizable threshold, or else it is some other frame and either the measured variation of resistive torque variation $\Delta C_{i-1}$ is less than a fifth parameterizable threshold, or said torque variation $\Delta C_{i-1}$ offset as a function of the speed through the frame i, where i>1, is greater than a sixth parameterizable threshold.

The distribution key for frames of a multi-frame mill can then be written in the following form for variations in the zero-traction rolling torque $\Delta C_{L,O,i}$.

where $$\sum_{i=1}^{n} \Delta C_{L,0,i} \cdot \frac{r_i}{R_i} = \beta \cdot S_0 \sum \lambda_i = S_0 \text{ where}$$

$$\beta = \frac{1}{\sum \lambda_i}$$

This form suits well regardless of the torque levels of the frames.

The distribution key for frames in a multi-frame mill when variations are associated with traction stress $\Delta C_{T,i}$ is such that:

$$\Delta C_{T,i} = \Delta C_i - \frac{\lambda_i}{\sum \lambda_i} S_o \frac{R_i}{ri}$$

and the following still applies:

$$\sum \frac{r_i}{R_i} \Delta C_{r,i} = 0$$

It is then possible to estimate the contributions of upstream and downstream traction respectively to the total traction torque of the motor for a frame in each of the frames, working back from the outlet frame $\mathbf{1}_n$ of the mill and working frame by frame to the inlet frame $\mathbf{1}_1$.

This estimate is then established using the following relationships:

$$\begin{cases} \Delta C_{T,n} = \dfrac{T_{n-1} \cdot R_n}{r_n} \\ \Delta C_{T,n-1} = \dfrac{T_{n-2} \cdot R_{n-1}}{r_{n-1}} - \dfrac{T_{n-1} \cdot R_{n-1}}{r_{n-1}} \\ \Delta C_{T,1} = -\dfrac{T_1 \cdot R_1}{r_1} \end{cases}$$

The traction and/or compression forces between frames $T_i$ can be determined on the basis of the above-defined relationships.

The control system used is a system that is entirely digital where all of the tractions between frames are calculated periodically at the sampling period of the system.

Thus, at instant t=n.T, where T is the sampling period and where n is the sampling index, the following a can be written:

$$C_{mem,i}(n) = C_{mem,o,i} + \sum_{j=1}^{n} \Delta C_{t,o,i}(j)$$

where $C_{mem,0,i}$ represents the reference torque stored at instant t=0 and equivalent to the zero-traction rolling torque on entering frame i.

$C_{mem,i}(n)$ is the torque stored for frame i at instant n.T.

$\Delta C_{L,0,i}(j)$ represents variation in the zero-traction rolling torque of frame i at instant t=j.T relative to the preceding instant (j−1).T.

$\Delta C_i(n)$ which is the variation in the rolling torque of frame i relative to the torque stored at the preceding instant is then written:

$$\Delta C_i(n) = \Delta C_{L,0,i}(n) + \Delta C_{T,i}(n) = C_i(n) - C_{mem,i}(n-1)$$

where $C_i(n)$ is the rolling torque of frame i at instant n.T.

The torques $C_{mem,i}$ and the torque variations $\Delta C_i$ are calculated at each sampling instant as specified above.

Torque variations $\Delta C_{L,0,i}$ and $\Delta C_{T,i}$ are then calculated in application of the above-described algorithm using the distribution key.

It is fundamental to observe that a characteristic of the invention is to update continuously the stored reference torque $C_{mem,i}$ which represents the zero-traction rolling torque of frame i as it varies during rolling.

The inter-frame traction torques are thus regulated and, in contrast, there is no regulation in terms of total resistive torque at any of the frames. A fault, such as a variation in the hardness or a variation in the dimensions of the product gives rise to a step in the resistive torque when said fault is to be found in a frame, and this leads to the control system implementing the method of the invention trying to eliminate the inter-frame variations in tension/compression stresses that necessarily appear because of changes in the section of the product leaving the frame and changes in slip downstream from said frame. Corrections are thus performed in cascade, frame by frame.

What is claimed is:

1. A method of regulating tension/compression in a multi-frame rolling mill working on hot metal products, wherein, starting from an initial situation while a product is being passed into the various frames of the run, torque is measured at each frame through which the product passes at the moment when said product reaches the following frame downstream therefrom, the measured value is stored as a reference value, and the frame for which the measurement is made is switched from speed regulation to torque regulation, and wherein the last frame into which the product enters acts as a speed controlling frame for all other frames situated upstream therefrom, thereby retaining torque equal to the reference torque by varying the speed.

2. A method of regulation according to claim 1, in which, from the moment when reference torque measurements have been stored as rolling reference values, a distribution key for traction stresses between frames of the run is used such that:

$$\Delta C_{T,i} = \Delta C_i - \frac{\lambda_i}{\sum \lambda_i} S_o \frac{R_i}{r_i}$$

where:

$\Delta C_{T,i}$ corresponds, depending on its sign, to the variation in the traction or compression stress for the frame of rank i amongst the n frames of the run;

$R_i$ and $r_i$ are the working radius and the reduction ratio for the frame of rank i;

$S_0$ corresponds to the sum of the measured resistive torque variations ($\Delta C_i$) as seen by the mechanism ($\Delta C_i r_i$) and divided by the lever arm ($\Delta C_i . r_i / R_i$), where $\Delta C_i$ is the variation in the resistive torque $C_i$ relative to the reference torque stored for the frame of rank i;

with $\lambda_i$ equal to zero, either if the product $S_0 . \Delta C_i$ is negative, or if the product $S_0 . \Delta C_i$ is positive when dealing with the first frame and the measured variation of resistive torque $\Delta C_i$ offset as a function of speed through the second frame exceeds a parameterizable threshold, or else if the product $S_0 . \Delta C_i$ is positive while the measured variation of resistive torque $\Delta C_{i-1}$ is greater than a second parameterizable threshold and said measured variation of resistive torque $\Delta C_{i-1}$ offset as a function of the speed through the frame i, where i>1, is less than a third parameterizable threshold; or $\lambda_i$ is equal to $\Delta C_i$ if the product $S_0 . \Delta C_i$ is positive when dealing with the first frame and the measured variation of resistive torque $\Delta C_i$ offset as a function of speed through the second frame is less than a fourth parameterizable threshold, or when dealing with some other frame and the measured variation of resistive torque $\Delta C_{i-1}$ is less than a fifth parameterizable threshold, or said torque variation $\Delta C_{i-1}$ offset as a function of the speed through frame i, where i>1, is greater than a sixth parameterizable threshold.

3. A control system for a multi-frame rolling mill working on hot metal products, in which the frames are controlled by programmed logic control units, the control units being controlled by at least one common supervisor unit, the system including hardware and software for:

measuring the value of the torque, at each frame through which a product passes, at the moment when said product reaches the following frame downstream therefrom;

switching from speed regulation to torque regulation for the frame through which said product is passing when the product reaches the following frame downstream therefrom; and activating the last frame through which the product passes as a speed-controlling frame for all other frames situated upstream therefrom.

4. A control system according to claim 3, wherein, from the moment when the value of the torque is measured, a distribution key for traction stresses between frames of the run is used such that:

$$\Delta C_{T,i} = \Delta C_i - \frac{\lambda_i}{\sum \lambda_i} S_o \frac{R_i}{r_i}$$

where:

$\Delta C_{T,i}$ corresponds, depending on its sign, to the variation in the traction or compression stress for the frame of rank i amongst the n frames of the run;

$R_i$ and $r_i$ are the working radius and the reduction ratio for the frame of rank i;

$S_0$ corresponds to the sum of the measured resistive torque variations ($\Delta C_i$) as seen by the mechanism ($\Delta C_i r_i$) and divided by the lever arm ($\Delta C_i . r_i / R_i$), where $\Delta C_i$ is the variation in the resistive torque $C_i$ relative to the reference torque stored for the frame of rank i with $\lambda_i$ equal to zero, either if the product $S_0 . \Delta C_i$ is negative, or if the product $S_0 . \Delta C_i$ is positive when dealing with the first frame and the measured variation of resistive torque $\Delta C_i$ offset as a function of speed through the second frame exceeds a parameterizable threshold, or else if the product $S_0 . \Delta C_i$ is positive while the measured variation of resistive torque $\Delta C_{i-1}$ is greater than a second parameterizable threshold and said measured variation of resistive torque $\Delta C_{i-1}$ offset as a function of the speed through the frame i, where i>1, is less than a third parameterizable threshold; or $\lambda_i$ is equal to $\Delta C_i$ if the product $S_0 . \Delta C_i$ is positive when dealing with the first frame and the measured variation of resistive torque $\Delta C_i$ offset as a function of speed through the second frame is less than a fourth parameterizable threshold, or when dealing with some other frame and the measured variation of resistive torque $\Delta C_{i-1}$ is less than a fifth parameterizable threshold, or said torque variation $\Delta C_{i-1}$ offset as a function of the speed through frame i where i>1, is greater than a sixth parameterizable threshold.

* * * * *